US006665902B1

(12) United States Patent
Vegter

(10) Patent No.: US 6,665,902 B1
(45) Date of Patent: Dec. 23, 2003

(54) METALLIC WIRE STRIP BRUSH ASSEMBLY AND APPARATUS AND METHOD FOR MAKING

(75) Inventor: Hinderikus A. Vegter, Barrie (CA)

(73) Assignee: United Rotary Brush Corporation, Lenexa, KS (US)

( * ) Notice: Subject to any disclaimer, the term of this patent is extended or adjusted under 35 U.S.C. 154(b) by 453 days.

(21) Appl. No.: 09/651,112

(22) Filed: Aug. 30, 2000

Related U.S. Application Data

(60) Provisional application No. 60/198,636, filed on Apr. 20, 2000.

(51) Int. Cl.[7] ..... A46B 3/00; A46B 3/20; A46D 3/00

(52) U.S. Cl. ..... 15/183; 15/200; 15/191.1; 300/21

(58) Field of Search ..... 15/183, 200, 191.1, 15/193, 383, 366, 179; 300/21

(56) References Cited

U.S. PATENT DOCUMENTS 2,734,211 A * 2/1956 Vance ..... 15/183
3,072,945 A * 1/1963 Peterson ..... 15/202
5,358,311 A * 10/1994 Drumm ..... 604/195
5,400,458 A * 3/1995 Rambosek ..... 15/179
5,445,438 A * 8/1995 Drumm ..... 300/21
5,605,383 A * 2/1997 Biocca ..... 300/21

FOREIGN PATENT DOCUMENTS

DE 2909638 * 9/1980

* cited by examiner

*Primary Examiner*—Robert J. Warden, Sr.
*Assistant Examiner*—Laura C Cole
(74) *Attorney, Agent, or Firm*—Clark & Brody

(57) ABSTRACT

A strip brush assembly for sweeping devices or machines comprises a plurality of metallic wires with attachment ends thereof being secured to a polymeric hub. The hub, while retaining the wire ends together is bonded or attached to a polymeric base that is configured with a channel to receive the hub. The base also has members shaped to secure the base to a brush assembly holder. An apparatus for making the brush assembly includes an extruder/shaping device that takes lengths of wires and continuously extrudes and shapes the hub around ends of the wires. The hub is then continuously attached to a polymeric base using fusion, adhesives, a combination of the two, or the like. The hub-containing base can then be cut to length as a metallic wire strip brush assembly for use on a mandrel.

9 Claims, 2 Drawing Sheets

METALLIC WIRE STRIP BRUSH ASSEMBLY AND APPARATUS AND METHOD FOR MAKING

This application claims priority under 35 U.S.C. §119(e) of U.S. Ser. No. 60/198,636, filed Apr. 20, 2000.

FIELD OF THE INVENTION

The present invention is directed to a metallic wire strip brush assembly and a method and apparatus for making the strip brush, and particularly, to metallic wire brushes that are attached to a non-metallic base strip for use in sweeping machines using mandrels.

BACKGROUND ART

In the prior art, various types of brushes, brush assemblies, and brush-making apparatus and methods have been proposed. These brushes are used in a variety of applications, including street sweepers, sweeping machines for airport use, deburring machines, and the like. U.S. Pat. No. 4,998,316 to Maltarp (herein incorporated in its entirety by reference) discloses one type of a brush that is formed into a ring for use on mandrels for sweeping, brushing, etc. Referring to FIG. 1, one brush product of Maltarp is designated by the reference numeral 10 and includes wires 1 formed into a brush assembly for use with a ring. A plastic annular hub 3 is formed on one end of the wires to hold the wires in place. A metallic ring 5 is then crimped around the plastic hub, the crimped portions designated by reference numeral 7. The Maltarp patent is an improvement over wire brushes that employed locking wires within the metallic ring.

Another brush construction is disclosed in U.S. Pat. No. 5,819,357 to Gould and shown in FIG. 2 as brush construction 20. This construction is an all-polymer construction wherein polymer bristles are used with a polymer strip. The strip is configured to slide into channels in a mandrel of a sweeping machine. The brush construction 20 comprises bristles 21 extending from a base strip 23. Molding the bristle ends into the base strip forms the construction 20, see column 5, lines 1–12.

Another all-polymer strip construction is found in strips made by Sweeper Brushes, Inc. of Barrie, Ontario, Canada. Referring to FIG. 3, these strip brushes 30 have polymeric bristles 31 inserted into a strip 33. The ends of the bristles are fusion bonded at 35 to the base of the channel formed in the strip.

U.S. Pat. No. 2,400,809 to Cave discloses a brush construction and method of making. In Cave, a groove is formed in a base strip. A thermo-plastic or thermo-setting powder material is fed into the groove. Bristles are folded and then the folded ends are inserted into the filled groove. Insertion of the bristle ends causes the material to fluff up and flow between the interstices of the bristles. Heat is then applied to secure the bristle ends to the material.

In the prior art, it is sometimes desirable to have a metallic wire brush rather than a polymer brush for sweeping or cleaning purposes, particularly for machines that employ mandrels or other strip brush holders. Metallic wire brushes provide a more aggressive brushing action than brushes employing polymer bristles. However, none of the above-mentioned prior art brushes employ a metallic wire brush in a polymer strip for use with mandrels of sweeping machines. As such, a need exists for such a product where more aggressive brushing or sweeping is desired.

The present invention solves this need by providing a metallic wire brush strip assembly, which employs a polymer strip for attachment to mandrels or other holders of sweeping machines, and a method and apparatus to make such a metallic wire brush product.

SUMMARY OF THE INVENTION

It is a first object of the present invention to provide an improved metallic wire strip brush assembly.

Another object of the invention is an apparatus for continuously making a metallic wire strip brush assembly.

A further object of the invention is a method of continuously making a metallic wire strip brush assembly.

Other objects and advantages of the present invention will become apparent as a description thereof proceeds.

BRIEF DESCRIPTION OF THE DRAWINGS

Reference is now made to the drawings of the invention wherein.

DESCRIPTION OF THE PREFERRED EMBODIMENTS

The present invention offers significant advantages over the strip brush assemblies of the prior art. Whereas the prior art strip brush assemblies are limited to those employing locking wires, or an all-polymer construction, ring configurations, and the like, the invention fills a void in the art by providing a metallic wire strip brush assembly that eliminates the need for locking wires, can be used in strip form for mandrel applications, and is efficiently and economically made using methods and apparatus employing continuous making techniques. The invention satisfies a long-felt need in the brush art not met by prior art brush designs.

Figure 1:
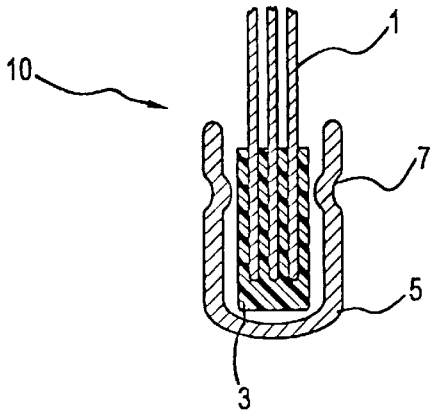
FIG. 1 PRIOR ART
FIG. 1 is a sectional view of a prior art metallic wire brush ring construction.
Figure 2:
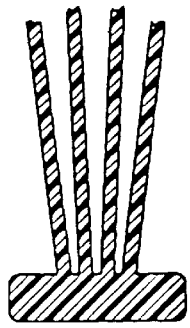
FIG. 2 PRIOR ART
FIG. 2 is a sectional view of one prior art polymer strip brush construction.
Figure 3:
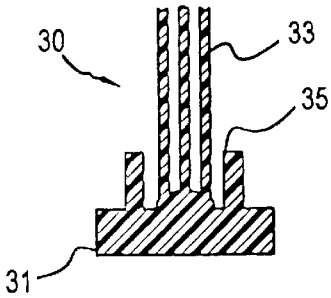
FIG. 3 PRIOR ART
FIG. 3 is a sectional view of another prior art polymer strip brush construction.
Figure 4:
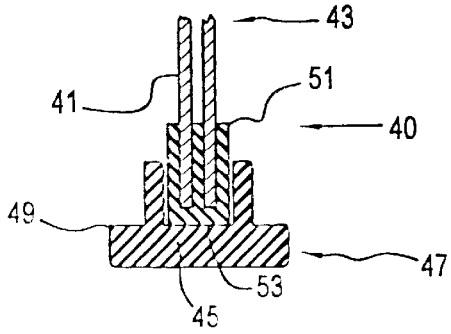
FIG. 4 is a sectional view of one embodiment of the invention.

FIG. 4 shows one embodiment of the invention as a strip brush assembly 40. The assembly 40 has a number of metallic wires 41. The wires are depicted as being relatively straight, but they can be crimped or undulating if desired. The wires 41 can be made out of any type of a metallic material, such as galvanized steel, stainless steel, and the like. Each wire has a brushing end 43 and an opposite or attachment end 45. The brushing end 43 is exposed to contact a desired surface or object for the intended brushing action.

The assembly 40 also has a base 47. The base is made of a polymeric material such as polypropylene. Other polymeric materials as well as homopolymers and copolymers could also be employed as would be within the skill of the artisan.

The base 47 employs protrusions 49 to facilitate attachment to a mandrel or the like. The protrusions 49 would slide into channels formed on the mandrel as shown in the Gould patent noted above.

The assembly 40 also has a polymeric hub 51, which is secured or attached to the ends 45 of the wires 41. The hub 51 is made of a polymeric material so that is can attach to the base 47.

In the FIG. 4 embodiment, the attachment between the hub 51 and the base 47 is shown as a zone 53 wherein the hub 51 is bonded to the base 47. The bond can be a fusion bond whereby the polymeric material of the hub 51 fuses with the material of the base 47. This fusion bond then secures the wires 41 to the base 47.

The base 47 can be formed in a continuous manner and then cut into finite lengths to fit a given size mandrel or the like. For example, the finished strip brush assembly 40 may be made in 48-inch lengths, or other lengths as needs would dictate.

When fusing the material of the base 47 to the hub 51, the materials of each should be compatible for fusing, e.g., both being made from polypropylene. Of course, other compatible materials could be employed, e.g., polyethylene, and other polyolefins.

Although not shown in FIG. 4, the wires 41 extend along the base in a continuous manner so that the brushing ends 43 form a continuous and relatively uninterrupted brushing surface for uniformity during brushing. Of course, if desired, the wires could be attached to the base so as to form spaced intervals therealong, akin to a tufted brush design. In this mode, the groups of wires would extend generally continuously along the base, followed by a space, then followed by another grouping of wires, and so on.

Figure 5:
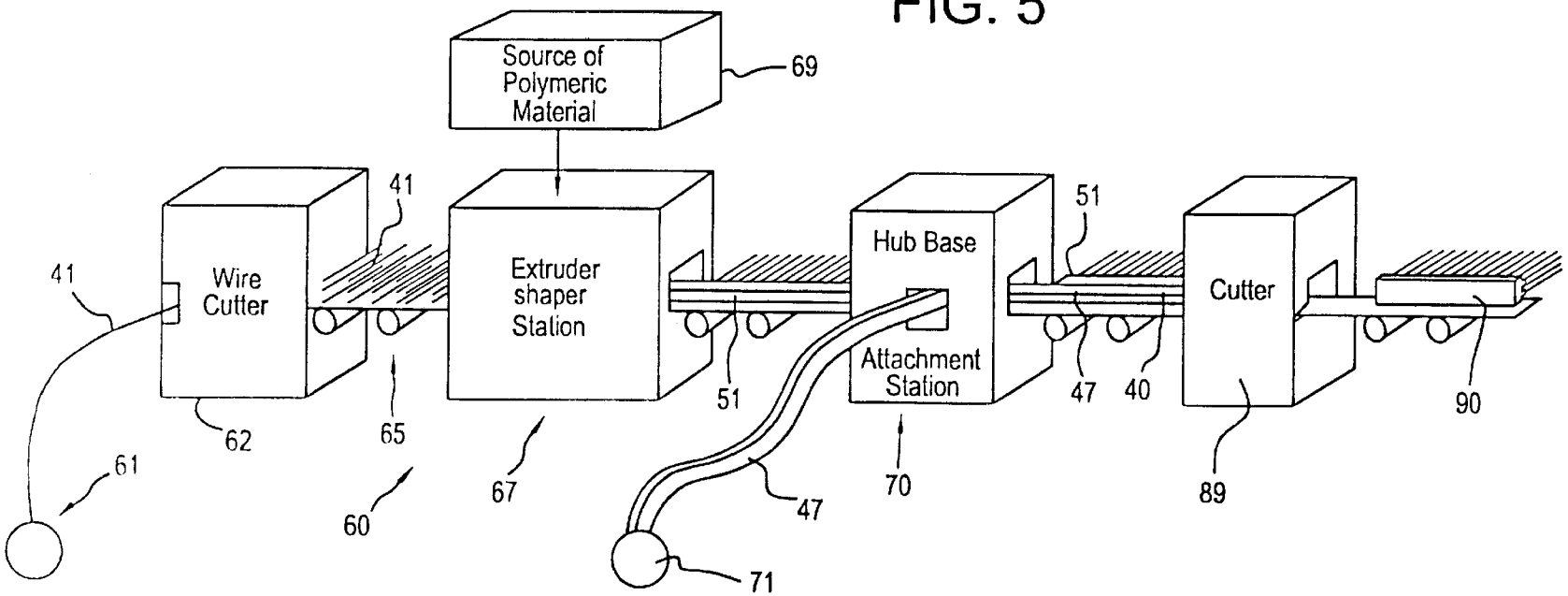
FIG. 5 is a schematic of one embodiment of the apparatus aspect of the invention.

Referring now to FIG. 5, an exemplary apparatus 60 is disclosed to make the embodiment of the invention depicted in FIG. 4. It should be understood that the FIG. 5 apparatus is but one way to make the strip brush assembly. The apparatus uses a source of the metallic wire 41, e.g., a continuous form on a pay-off reel 61. The wire is continuously fed to a cutter 62 wherein the wire is cut into predetermined lengths and laid on a conveying device 65. Any type of cutting device can be employed that would accomplish such a purpose. Alternatively, precut lengths could be fed to the apparatus whereby the cutter would be optional.

The conveying device 65 preferably conveys the wires through the various stations of the apparatus so the brush assembly is continuously made. Of course, more than one conveying device can be employed, is desired. Any type of conveying device can be employed, a belt, a series of spaced-apart belts or the like.

The cut wires 41 are fed to an extruder/shaper station 67, wherein the hub 51 is extruded and shaped about the wire ends 45. The extrusion station 67 uses a source of a polymeric material 69 and an extrusion press (not shown) whereby the polymeric material is melted and extruded onto the ends 45 as they travel through the station 67. The extruded polymer-wire combination is then cooled sufficiently so that the polymer-containing wire ends can pass through a compression and shaping device as part of station 67 wherein the polymeric material is formed into the hub shape and the wire ends are firmly embedded into the extruded mass of polymeric material. Thus, the ends 45 do not become easily dislodged during transport, handling, or brushing operations.

After hub formation, the hub-containing wires are still supported by the conveying device 65 and fed to another station 70 wherein the hub 51 and base 47 are attached together. As part of this station, the base 47 can be provided in continuous form and can be payed off a reel 71. The base is then guided using rolls, fixed guides or the like and merged with the traveling hub 51, so that the hub 51 engages a channel or other recess of the base 47 as both are traveling along the apparatus.

Figure 6:
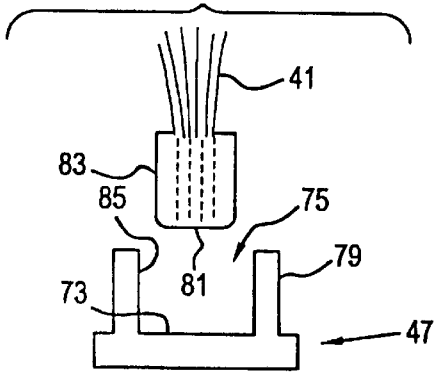
FIG. 6 shows components of the inventive strip brush assembly in side view.

The base 47 has a base surface 73 extending between legs 79 of a channel 75, see FIG. 6. The surface 73 can be heated prior to mating of the hub 51 and the base 47, the heat sufficient to fuse at least a bottom 81 of the hub 51 to the base surface 73. Heat can be applied using a heating bar positioned so that the base surface 73 travels along the heating bar prior to the hub engaging the channel 75. Alternatively, heat via the bar could be applied to the hub 51. Other forms of heat may also be used, e.g., hot gases, radiant heat, or any other type within the skill of the art. The amount of heat should be sufficient to cause the desired fusion between the hub 51 and the base 47 without compromising the integrity of either. Too much heat may allow the wire ends 45 to slip out of the hub or weaken the base. Too little heat may not form a sufficient bond between the hub 51 and the base 47 to keep them together.

While it is disclosed that heat could be applied to the channel base surface 73 so that a bond is formed at the interface between the bottom 81 of the hub 51 and the surface 73, the hub and channel could be sized so that a bond between the sides 83 of the hub 51 and the sides 85 of the channel legs 79 is also formed, either in substitution for the surface 73-bottom 81 bond or in addition thereto.

While the hub is shown extending beyond the legs 79 of the channel 75, the leg and hub dimensions could vary. For example, the legs 79 could be sized to extend beyond a top surface of the hub 51.

Downstream of station 70, the completed and continuous brush assembly 40 is ready for either cutting into finite strips 90 via cutter station 89, or collected continuously on a reel (not shown) of the like for later cutting or use.

As noted above, the cut strips 90 can then be packaged for later use on a mandrel or other holder, or can be directly attached to one or more mandrels when cut.

Although the wire is depicted with free ends 45 attached to the hub 51, the wire 41 could be cut and folded into a v-shape such that each free end acts as a brushing end and the v-shaped fold is the attachment end that is secured to the hub.

Although an extrusion process is a preferred method of forming the hub 51 around the ends 45, other techniques to secure the ends 45 together in a polymeric material suitable for attachment to the base 47 can be employed. For example, the wire ends 45 could be spray coated with a polymer, dipped into a polymer bath, contacted by a polymer-dispensing roller, or the like.

Similarly, although the base is shown as a preformed material fed off a pay-off reel, the base could be extruded or formed along with the hub. In this mode, the base could be extruded, the hub could be extruded, and both could then be merged so that the residual heat in each of the hub and the base contribute or cause bonding between the two. A source of supplemental heat could be employed, if desired, to heat either a portion or all of the hub and/or the base for bonding or bonding enhancement, when the base is also extruded.

In yet another mode, an adhesive could be employed to attach the hub 51 to the base 47 rather than employing a fusion bond. Alternatively, adhesive could be used in addition to the fusion bonding technique noted above. The adhesive could be applied to one or both of the hub and the base to effect attachment between the two.

Although the hub is shown with a generally rectangular cross section to interface with the channel in FIGS. 4 and 6, the hub could be formed with any cross sectional shape by the appropriate selection of the hub-shaping device. Likewise, the base could have any cross-sectional configuration to not only mate with the hub but also facilitate attachment to a brush assembly holding device such as a mandrel. Further, the polymeric material could be applied to the wire ends 45 through extrusion, coating, etc. and be allowed to cool to retain the wire ends together, without the shaping step or device disclosed above. The application of the polymer in this mode should be such that sufficient contact is made between polymer and wire ends to hold the wire ends in place upon cooling.

As such, an invention has been disclosed in terms of preferred embodiments thereof which fulfill each and every one of the objects of the present invention as set forth above and provides new and improved metallic wire strip brush assembly, and a method and apparatus for making the same.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A strip brush assembly comprising:

a) a plurality of metallic wires, each wire having at least one brushing end and another attachment end;

b) a polymeric hub surrounding and being attached to the attachment ends of the plurality of metallic wires;

c) a polymeric base having a channel therein, at least a portion of the hub being positioned in the channel and attached to a portion of the channel, the base also having members for attachment to a strip brush assembly holder;

d) wherein the portion of the hub attached to the portion of the base is fusion bonded.

2. The assembly of claim 1, wherein the strip brush assembly comprises a discrete length for attachment to the strip brush assembly holder.

3. The assembly of claim 1, wherein the hub is an extrusion of a polymeric material.

4. A strip brush assembly comprising:

a) a plurality of metallic wires, each wire having at least one brushing end and another attachment end;

b) a polymeric hub surrounding and being attached to the attachment ends of the plurality of metallic wires;

c) a polymeric base having a channel therein, at least a portion of the hub being positioned in the channel and attached to a portion of the channel, the base also having members for attachment to a strip brush assembly holder;

d) wherein the hub is an extrusion of a polymeric material, and the portion of the hub attached to the portion of the base is fusion bonded.

5. The assembly of claim 4, wherein the strip brush assembly comprises a discrete length for attachment to the strip brush assembly holder.

6. A strip brush assembly comprising:

a) a plurality of metallic wires, each wire having at least one brushing end and another attachment end;

b) a polymeric hub surrounding and being attached to the attachment ends of the plurality of metallic wires the attachment ends embedded in the polymeric hub;

c) a polymeric base having a channel therein, at least a portion of the hub being positioned in the channel and attached to a portion of the channel, the base also having members for attachment to a strip brush assembly holder;

d) wherein the hub is an extrusion of a polymeric material, and the portion of the hub attached to the portion of the base is fusion bonded.

7. The assembly of claim 6, wherein the strip brush assembly comprises a discrete length for attachment to the strip brush assembly holder.

8. A strip brush assembly comprising:

a) a plurality of metallic wires, each wire having at least one brushing end and another attachment end;

b) a polymeric hub surrounding and being attached to the attachment ends of the plurality of metallic wires, the attachment ends embedded in the polymeric hub;

c) a polymeric base having a channel therein, at least a portion of the hub being positioned in the channel and attached to a portion of the channel, the base also having members for attachment to a strip brush assembly holder;

d) wherein the portion of the hub attached to the portion of the base is fusion bonded.

9. The assembly of claim 8, wherein the strip brush assembly comprises a discrete length for attachment to the strip brush assembly holder.

* * * * *

UNITED STATES PATENT AND TRADEMARK OFFICE

CERTIFICATE OF CORRECTION

PATENT NO. : 6,665,902 B1
DATED : December 23, 2003
INVENTOR(S) : Hinderikus A. Vegter It is certified that error appears in the above-identified patent and that said Letters Patent is hereby corrected as shown below:

Title page,
Item [54], Title, should read:
-- METALLIC WIRE STRIP BRUSH ASSEMBLY --

Signed and Sealed this

Fourth Day of May, 2004

JON W. DUDAS
*Acting Director of the United States Patent and Trademark Office*